US007309942B2

(12) United States Patent
Hilton

(10) Patent No.: US 7,309,942 B2
(45) Date of Patent: Dec. 18, 2007

(54) PIEZOELECTRIC TRANSDUCER SYSTEMS

(75) Inventor: John Allen Hilton, North Turramurra (AU)

(73) Assignee: Sportzwhistle Pty Ltd, Queensland (AU)

( * ) Notice: Subject to any disclaimer, the term of this patent is extended or adjusted under 35 U.S.C. 154(b) by 406 days.

(21) Appl. No.: 10/517,057

(22) PCT Filed: Jun. 4, 2003

(86) PCT No.: PCT/AU03/00701

§ 371 (c)(1),
(2), (4) Date: Dec. 3, 2004

(87) PCT Pub. No.: WO03/105527

PCT Pub. Date: Dec. 18, 2003

(65) Prior Publication Data

US 2005/0219952 A1 Oct. 6, 2005

(30) Foreign Application Priority Data

Jun. 5, 2002 (AU) ..... PS2792

(51) Int. Cl.
*H01L 41/08* (2006.01)

(52) U.S. Cl. ..... 310/322; 310/324

(58) Field of Classification Search ..... 310/321, 310/322, 324, 330
See application file for complete search history.

(56) References Cited

U.S. PATENT DOCUMENTS

| | | | | | |
|---|---|---|---|---|---|
| 3,365,593 | A | * | 1/1968 | Roof et al. | 310/319 |
| 4,047,060 | A | * | 9/1977 | Schafft | 310/322 |
| 4,193,647 | A | * | 3/1980 | Guess et al. | 310/324 |
| 4,705,981 | A | * | 11/1987 | Inoue et al. | 310/324 |
| 4,754,440 | A | | 6/1988 | Naruse | |
| 4,755,975 | A | * | 7/1988 | Ito et al. | 367/140 |
| 4,761,582 | A | | 8/1988 | McKee | |
| 4,933,589 | A | * | 6/1990 | Strubbe | 310/323.21 |
| 5,115,472 | A | * | 5/1992 | Park et al. | 381/152 |
| 5,642,332 | A | | 6/1997 | Chang et al. | |

FOREIGN PATENT DOCUMENTS

| | | |
|---|---|---|
| EP | 0220354 | 5/1987 |
| GB | 1 514 967 | 6/1978 |

* cited by examiner

*Primary Examiner*—Mark Budd
(74) *Attorney, Agent, or Firm*—McDermott Will & Emery LLP

(57) ABSTRACT

A transducer assembly has a generally planar resonator (12) (such as a disc) bonded on one face to a sheet of piezoelectric material (12B) and having a mounting flange (12C) (which may extend all around the periphery of the resonator) to mount the resonator between inner (13) and outer (11) mounting elements such as rings. An electric circuit (24) drives the piezoelectric sheet (12B) and, when used for sound generation, a tuned acoustic structure is provided for directing sound away from the resonator (12).

20 Claims, 3 Drawing Sheets

PIEZOELECTRIC TRANSDUCER SYSTEMS

FIELD OF THE INVENTION

The present invention relates to piezoelectric transducer systems and applications for such systems, for example operating in the audible sound spectrum or even at ultrasound frequencies.

BACKGROUND OF THE INVENTION

Piezoelectric transducers are in common usage in numerous products. They contain a diaphragm typically fabricated by attaching a smaller diameter thin piezoceramic disk onto a larger diameter thin metal disk. Applying a voltage across the piezoceramic disk produces stresses that cause the diaphragm to flex like a drum skin. By energising such a system at an audible sound frequency, sound can be generated. Diaphragms may be used on their own, as in wrist watches, but they are usually mounted onto an acoustic chamber with an opening to improve the acoustic power output of the transducer. Acoustic power output and/or sound directionality can further be enhanced with a suitably shaped air cavity that behaves like a horn.

One common method of mounting a diaphragm is to glue its nodal circle to a matching cylindrical protrusion that forms part of the acoustic chamber. The nodal circle's length does not change as the diaphragm flexes. Nodal mounting is inexpensive and has low mounting loads but exposes only the diaphragm surface within the nodal diameter to the acoustic chamber. Another common method is to mount the diaphragm by gluing or clamping it around a small peripheral annular region. This has higher mounting loads but exposes a larger portion of the diaphragm to the acoustic chamber and equivalent diaphragm flexing results in the centre deflecting further compared with nodal mounting.

One limiting factor of the acoustic power output is the tensile strength of the piezoceramic. Ceramics are typically much stronger in compression than in tension. Increasing the flexing vibration of the diaphragm by applying higher voltage waveforms increases acoustic power output. The fatigue life of the transducer depends mainly on the maximum tensile stress experienced by the piezoceramic. Specifying a required fatigue life for a transducer in turn determines the maximum vibrating deflection, the maximum driving voltage waveform and the maximum acoustic power output for a given frequency.

Previously published proposals in the field of transducers include U.S. Pat. No. 6,353,277 (Han-Jose), U.S. Pat. No. 5,514,927 (Tichy) and U.S. Pat. No. 5,030,872 (Boehnke & Pieper). These specifications are representative of particular configurations of transducers for particular purposes but in recognising this prior art no admission is made that any one item discloses any arrangement which is known or of general knowledge in Australia or any other country.

One important application envisaged for transducer arrangements embodying the present invention is to the field of sound generators and especially those intended to provide high volume output for alarms and applications, such as for use by referees in sporting events. However use of the invention in other applications and fields is envisaged.

SUMMARY OF THE INVENTION

In one aspect the present invention provides a transducer assembly comprising a) a resonator element having i) a sheet-like main body and ii) a mounting flange having a outer surface facing away from the main body and an inner surface facing towards the main body, b) first and second mounting elements engaging respectively the inner and outer surfaces to mount the resonator element c) a piezoelectric body bonded to the main body, and d) means for electrically connecting the piezoelectric body and the resonator element to and alternating current source for energising the resonator element and causing its resonation.

The invention also consists in assemblies further characterised by other additional features that can be advantageous and highly useful for particular applications as well as apparatus embodying the transducer assembly. Such apparatus can be adapted to be used for particular desired outputs such as an acoustic device for providing sound signals or other applications such as displacing an operating fluid in which the transducer assembly is in contact. In the latter case it may be appropriate to operate the transducer assembly at an ultrasonic frequency so that applications such as fluid pumping could be implemented a the device which could be very compact, durable, light weight and silent to the human ear. For example, a low pressure air supply could be provided in a device requiring air flow such as a personal fan. In such an application the device may readily be designed with sensors to activate the electrical circuitry to energise the system only when required. Thus, bulk complexity and the need for a mains power supply might be obviated.

However, a particularly significant field of application of many embodiments of the invention is to acoustic signals for alarm or similar purposes, for example for use by officials in refereeing a sports event.

The present invention lends itself to embodiments having electric circuitry to activate selected different frequency tones or patterns for different purposes. For example in sporting events, a first characteristic signal could be used by a referee to indicate there has been a rule infringement but advantage is being played and a second signal could be use to stop a play.

It is most advantageous for many applications to form the main body as a thin, planar, electrically conductive sheet with the mounting flange extending peripherally around the whole of the main body.

For example, the main body can be of disc-like form with the mounting flange integral with the main body. The mounting flange can extend to form a skirt, for example, of a cylindrical form extending perpendicular to the central plane of the main body and parallel to the axis of the resonator. In such an embodiment the mounting elements can be in the form of rings which rigidly clamp the skirt, for example in an interference fit.

In some embodiments the structure can be in the form of an electrically conductive main body, an electrically insulating bonding layer applied over one surface of the main body and a disc-like piezoelectric body thereby bonded intimately to the main body. The piezoelectric body typically has an electrically conductive coating on its free face that acts as a capacitive plate and facilitates the soldering of an electrical connection wire.

By attaching the electrical connection wire close to the periphery of the main body the location is where minimum displacement of the piezoelectric body occurs in use thereby minimising flexing and potential mechanical damage to the electric wire.

In another aspect the invention extends to an acoustic emitter comprising the transducer assembly as in any one of the forms described herein with a mounting for the transducer assembly and an electrical drive circuit adapted to energise the piezoelectric body at an acoustic frequency, the device further having an acoustic structure defining an acoustic path for sound generated by the resonator and extending away from the main body of the resonator on its side remote from the piezoelectric body. The acoustic structure can include a rigid body spaced from an adjacent resonator main body and having a central aperture which is small in area compared to the main body of the resonator.

An acoustic horn device can be matched to the transducer assembly to control acoustic output along the axis of the main body. The horn can be in the form of a tapering conical shape having a lesser diameter remote from the main body. The axial length of the horn can be similar to the dimension across the resonator main body. The horn may have an oval cross section.

In another aspect the present invention may be defined as providing an acoustic transducer assembly comprising a generally planar diaphragm having piezoelectric transducer material in a central portion and a mounting flange extending from a peripheral portion transversely to the generally planar diaphragm, and first and second mounting elements engaging and mounting the flange on its inner and outer sides respectively whereby an assembly is adapted to be mounted for acoustic output when the piezoelectric transducer is electrically driven.

Preferably the form of the diaphragm is disc-shaped with the flange being a depending skirt extending approximately at right angles to the general plane of the diaphragm.

In a preferred embodiment the first and second mounting elements are respective rings and the skirt is of corresponding shape to be clamped between the rings in an interference fit.

However, in another form one of the first and second mounting elements is a ring-shaped structure conforming substantially to the peripheral shape of the diaphragm and the other is a structural support element to which the diaphragm is securely attached.

In a preferred embodiment the diaphragm is a disc of brass or similar material and carries bonded thereto the piezoelectric element, the edges of this element being spaced inwardly from the inner mounting element. However, a wide range of materials may be used in place of brass.

Advantageously the transducer assembly is adapted to be mounted on a support base by a mounting cap which provides an acoustic chamber with an axially directed aperture through which sound is adapted to pass.

It has been found that with embodiments of the invention robustness, durability and high volume of sound generation can be achieved. In particular high applied voltages can be used without damage to the transducer device. It is believed that the mounting structure proposed facilitates resonance and simple mounting.

The inventor proposes the following explanation for the advantages which can be achieved in performance but this explanation is given to assist an understanding of the invention but the inventor is not to be bound by the completeness or correctness of this explanation and theory. It is believed that the form of the mount provides high rigidity and that consequently there is very little hysteresis and energy loss compared with commonly used mounts. Furthermore the rigid mounting is believed to result in greater energy storage capacity for the resonant mass/spring behaviour of the diaphragm for a given maximum piezoceramic tensile stress. Furthermore a compressive preload of the piezoceramic may be provided for as a result of a mechanical flexing preload left over from the drawing operation of the assembly. It is believed this preload may have the effect of permitting a greater stress range for a given maximum piezoceramic tensile stress. Thus the structure is of the nature of a tight drumskin or stretched membrane although the full reasons for improved acoustic power output in this case are not fully understood.

Embodiments of the invention can utilise low cost parts and low cost assembly operation to produce inexpensive but robust devices yet for a given size of device great acoustic power can be achieved.

In another aspect the invention may be defined as consisting in a device having a transducer assembly in any one of the forms described herein, wherein the device is arranged to provide an acoustic signal at about 3 kHz, the mass-spring resonance in the disc-shaped resonator is inherently at about 3 kHz, the electrical drive circuit has a capacitor-inductance resonance in the circuit of about 3 kHz, the piezoelectric body as an inherent resonance at about 3 kHz and the acoustic structure has inherent resonance at about 3 kHz and has an acoustic transformer cavity dimensioned to transform a high pressure, small displacement in the operating fluid in the structure into a low pressure, high displacement and high volume acoustic signal.

The inventor has observed that the characteristics of fluid such as air displacement is strongly influenced by the structure surrounding the free face of the main body of the resonator and therefore the structure needs to be designed to suit the application.

For illustrative purposes only an embodiment of the invention will now be described with reference to the accompanying drawings, of which:

Figure 2:
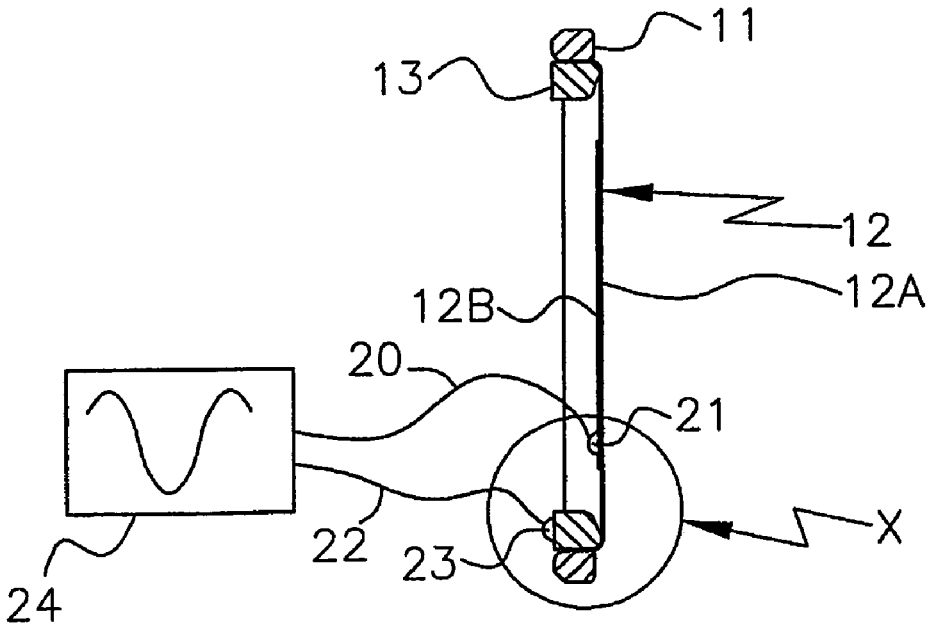
FIG. 2 is a cross sectional view taken along the line A-A in FIG. 1.

The illustrated transducer assembly has a transducer disc 12 having, centrally, a brass mounting plate 12A and a piezoceramic disc 12B bonded with electrically insulating adhesive material to a first surface as best shown in FIG. 2, the mounting plate 12A having a peripheral skirt 12C which rigidly mounts the transducer disc in an interference fit between an inner ring 13 and outer ring 11. The preferred profile of the rings is shown in the enlarged view of FIG. 3.

Figure 3:
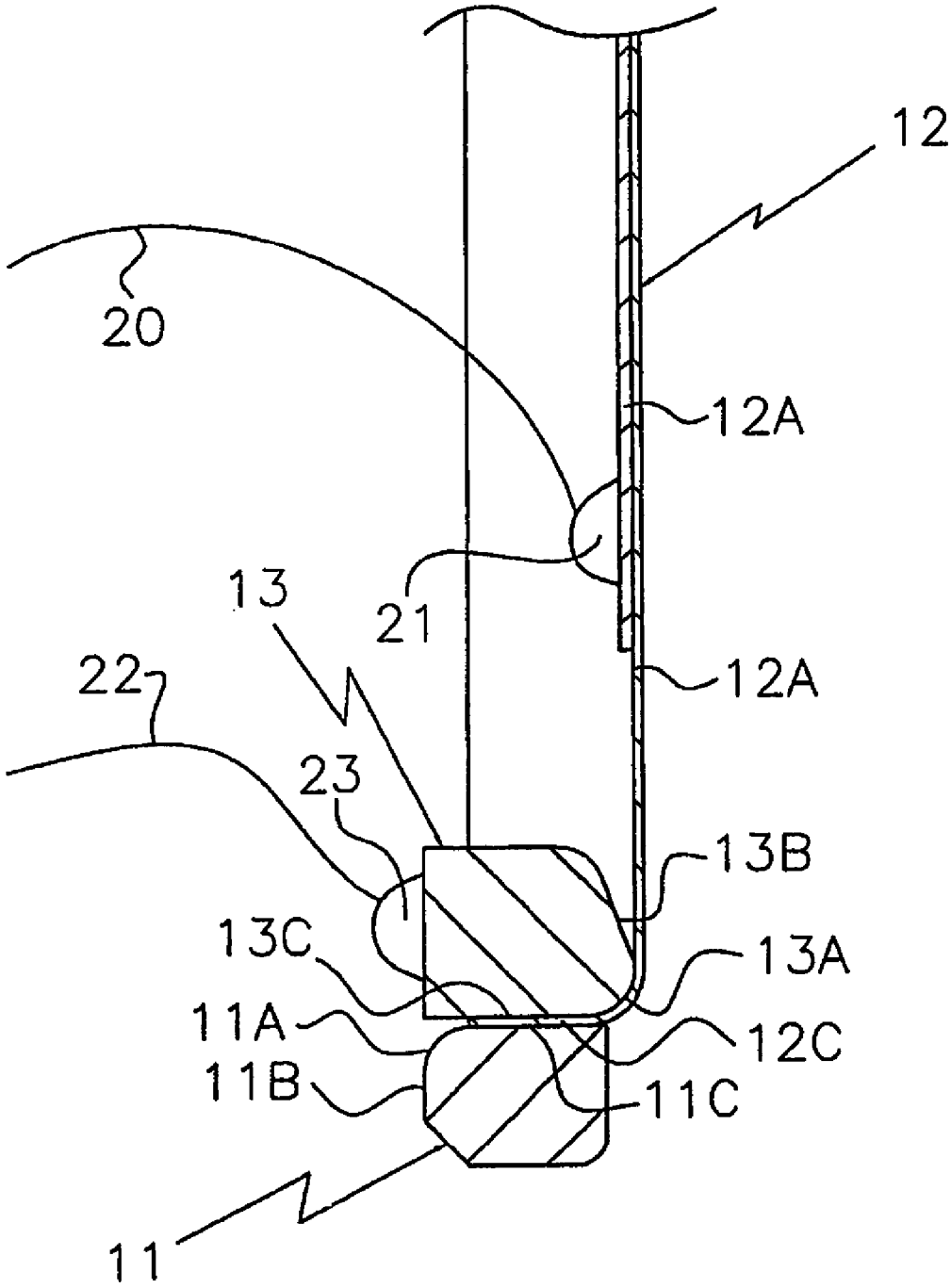
FIG. 3 is a view on an enlarged scale of portion X in FIG. 2 illustrating in cross-sectional view a preferred embodiment.

As showed in detail in FIG. 3, the inner ring 13 has a curved nose 13A with a part-circular profile extending from an inclined ramp 13B to an outer wall 13C which extends parallel to the axis of the ring. The outer ring 11 has a similar curved nose 11A at its lower inner corner connecting between a transverse wall 11B and an inner wall 11C which also extends substantially parallel to the axis of the ring. The profile of the rings is such that the structure shown in FIG. 3 is achieved by a drawing operation. Initially the brass disc 12 is flat and circular. The peripheral portion is engaged by the rings which engage the periphery of the brass disc in an interference fit. The periphery of the brass disc 12 is thus drawn down between the rings to form a rigid mounting.

FIG. 2 shows schematically an electric circuit 24 for driving the piezo assembly. A first connecting wire 20 is connected by electrical solder 21 to an outer peripheral portion of the piezoceramic disc 12B. A second flexible electrical connection wire 22 is connected by electrical solder 23 to the radial wall of the inner ring 13. The electrical wires 20 and 22 are connected to the electrical circuit 24 which is of conventional form and provides an electrical drive signal. The circuit 24 includes an auto transformer arrangement and a high current electronic switch, the device being powered by a suitable battery.

Figure 1:
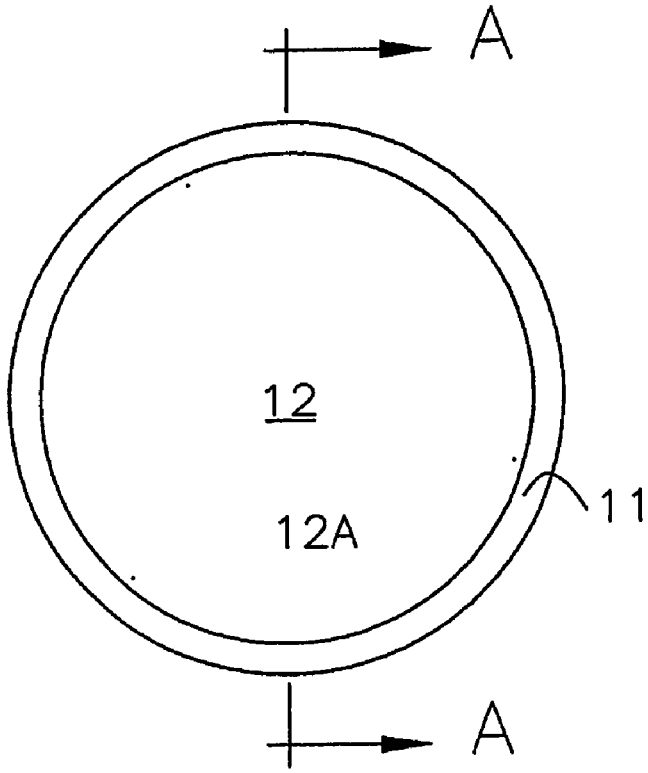
FIG. 1 is a plan view of a transducer assembly embodying the invention but shown schematically.
Figure 5:
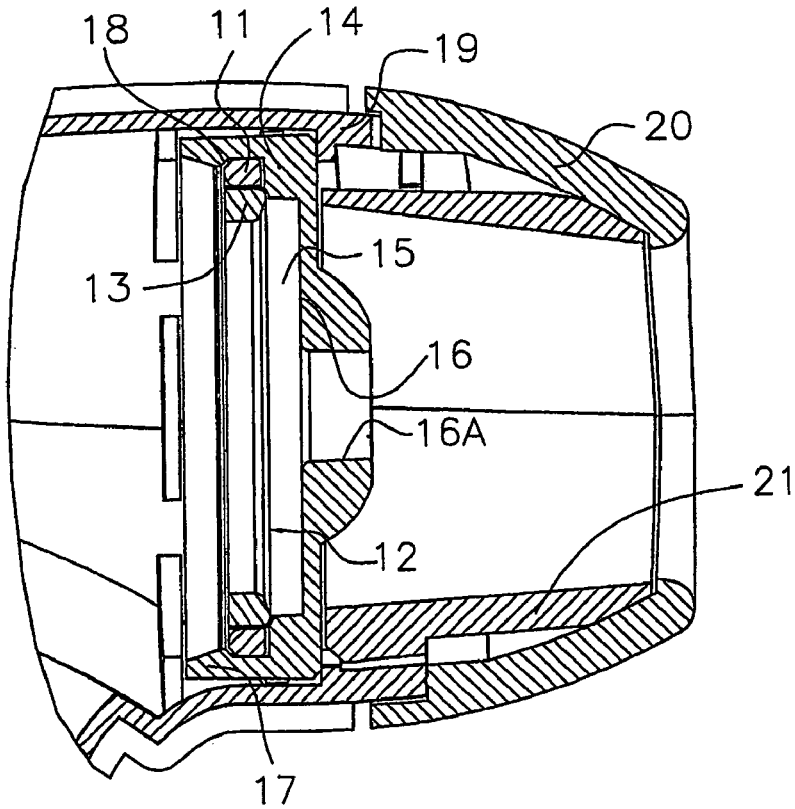
FIG. 5 is an axial cross sectional view showing assembly of the device of FIG. 4.

The assembly shown FIGS. 1 to 3 is adapted to be mounted in casing 14 which acts to provides an acoustic chamber 15 between the front of the brass plate 12A and a front wall 16 which has a small diameter, axially directed acoustic discharge port 16A, best shown in FIG. 5.

The casing 14 can be of any suitable materials such as a plastics material and in the illustrated embodiment a flange 17 extends around the periphery of the casing and has a shoulder 18 defining an undercut behind which the transducer assembly is snap fitted and adapted to be rigidly mounted. The unit including the casing is adapted to be fitted into a mounting barrel 19 which, at its free end, has a nose cone 20 and an interior oval acoustic horn 21.

The utilisation of the horn structure shown in FIG. 5 has been found to substantially increase the acoustic level of the signal. It is believed that a high pressure, small displacement signal in the acoustic chamber 15 is transformed by the horn to produce a low pressure but large displacement signal which has high acoustic intensity. This can be a great benefit for many applications.

With the assembly as shown in FIG. 5 provision in practice is made for the application of power from a battery to drive a transducer and control switching to activate the transducer are provided. The details are not shown in the drawing.

Figure 4:
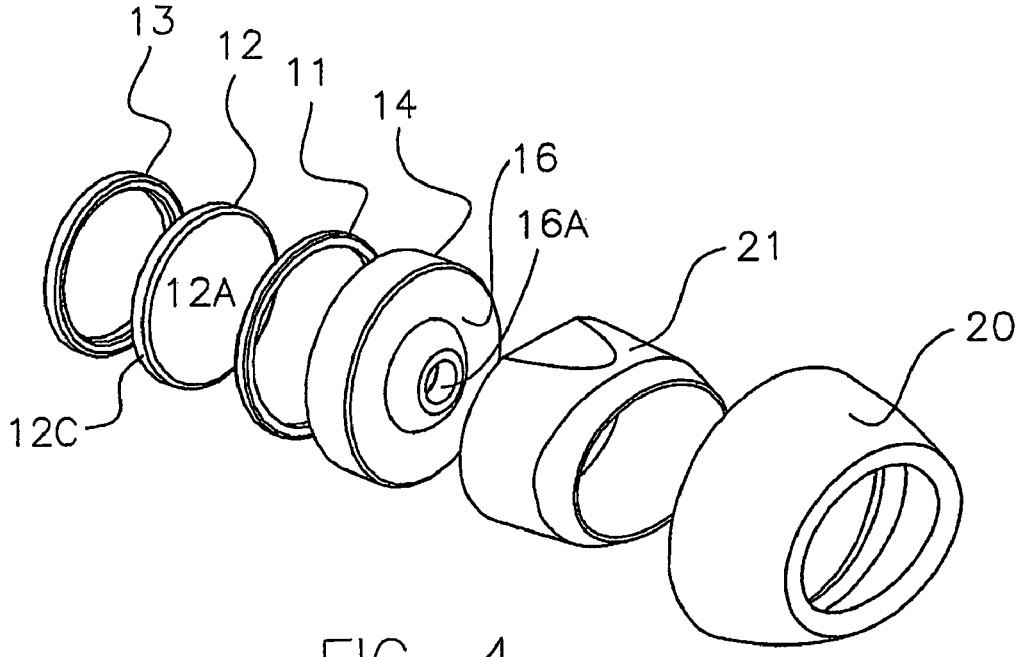
FIG. 4 illustrates in exploded view the components of a practical device using the concepts of FIGS. 1-3 and including an acoustic chamber and acoustic transformer cavity.

As an alternative to the embodiment shown in FIGS. 4 and 5, the outer ring 11 could be omitted and instead the skirt 12C could be bonded to the inner ring 13 and the profile of the casing 14 adjusted so as to cause the skirt and the inner ring 13 together to be fitted within the flange 17 of the casing.

A further alternative is to omit the inner ring 13 and to bond the outer ring 11 to the skirt 12C.

The invention claimed is:

1. A transducer assembly comprising a) a resonator element having i) a sheet-like main body and ii) a mounting flange having a outer surface facing away from the main body and an inner surface facing towards the main body, b) first and second mounting elements engaging respectively the inner and outer surfaces to mount the resonator element c) a piezoelectric body bonded to the main body, and d) means for electrically connecting the piezoelectric body and the resonator element to an alternating current source for energising the resonator element and causing its resonation, e) further comprising a mounting, an electrical drive circuit adapted to energise the piezoelectric body at an acoustic frequency and an acoustic structure defining an acoustic path for sound generated by the resonator and extending away from the main body of the resonator on its side remote from the piezoelectric body.

2. A transducer assembly as claimed in claim 1, wherein the main body is a thin, planar, electrically conductive sheet and the mounting flange extends peripherally around the whole of the main body.

3. A transducer assembly as claimed in claim 2, wherein the main body is of disc-like form, the mounting flange is integral with the main body and extends transversely to the central plane of the main body to form a skirt and the mounting elements are respective rings which rigidly clamp the skirt and are adapted to mount the transducer assembly in a structure.

4. A transducer assembly as claimed in claim 3, wherein the piezoelectric body is disc-like in form and extends over most of the main body and is bonded thereto by an electrically insulating compound.

5. A transducer assembly as claimed in claim 4, wherein the electrical connecting means comprises a first electrical lead connected to a radially outer face of the piezoelectric body remote from the main body and a second electrical lead connected to at least one of the rings which are electrically conductive.

6. A transducer assembly comprising a) a resonator element having i) a sheet-like main body and ii) a mounting flange having a outer surface facing away from the main body and an inner surface facing towards the main body, b) first and second mounting elements engaging respectively the inner and outer surfaces to mount the resonator element c) a piezoelectric body bonded to the main body, and d) means for electrically connecting the piezoelectric body and the resonator element to and alternating current source for energising the resonator element and causing its resonation e) further comprising a mounting, an electrical drive circuit adapted to energise the piezoelectric body at an acoustic frequency and an acoustic structure defining an acoustic path for sound generated by the resonator and extending away from the main body of the resonator on its side remote from the piezoelectric body, wherein the main body is a thin, planar, electrically conductive sheet and the mounting flange extends peripherally around the whole of the main body and, f) wherein the main body is of disc-like form, the mounting flange is integral with the main body and extends transversely to the central plane of the main body to form a skirt and the mounting elements are respective rings which rigidly clamp the skirt and are adapted to mount the transducer assembly in a structure and, g) wherein the piezoelectric body is disc-like in form and extends over most of the main body and is bonded thereto by an electrically insulating compound, and h) wherein the electrical connecting means comprises a first electrical lead connected to a radially outer face of the piezoelectric body remote from the main body and a second electrical lead connected to at least one of the rings which are electrically conductive, and i) wherein the rings engage the skirt in an interference fit and the skirt extends substantially parallel to the axis of the main body with a smoothly curved junction portion joining the main body and the skirt, with the inner ring having a corresponding curved shoulder for supporting the junction portion.

7. A transducer assembly as claimed in claim 1, wherein the assembly is of circular form and of dimensions of about 2 cm diameter and 2 mm axial depth.

8. An acoustic emitter as claimed in claim 1, wherein the electric drive circuit includes connectors for connection to a battery, control circuitry and an inverter for supplying an alternate current supply at about 3 kHz.

9. An acoustic emitter as claimed in claim 1, wherein the acoustic structure includes a rigid body spaced from and adjacent to the resonator main body and having a central aperture which is small in area compared to the main body of the resonator.

10. An acoustic emitter as claimed in claim 1, and further comprising a horn device acoustically matched to the transducer assembly to control the acoustic output along the axis of the main body.

11. An acoustic emitter as claimed in claim 10, wherein the horn is substantially a tapering conical shaped body having its lesser diameter remote from the main body and of a length similar to the dimensions across the resonator main body.

12. An acoustic emitter as claimed in claim 11, wherein the horn has an oval cross-sectional shape.

13. An acoustic emitter as claimed in claim 1, wherein the device is arranged to provide an acoustic signal at about 3 kHz, wherein the mass-spring resonance in the disc-shaped resonator is inherently at about 3 kHz, the electrical drive circuit has a capacitor-inductance resonance in the circuit of about 3 kHz, the piezoelectric body has an inherent resonance at about 3 kHz and the acoustic structure has inherent resonance at about 3 kHz and has an acoustic guide wall dimensioned to transform a high pressure, small displacement in the operating fluid in the structure into a low pressure, high displacement and high volume acoustic signal.

14. A device for displacing a fluid comprising a transducer assembly comprising a) a resonator element having
   i) a sheet-like main body and
   ii) a mounting flange having a outer surface facing away from the main body and an inner surface facing towards the main body,
b) first and second mounting elements engaging respectively the inner and outer surfaces to mount the resonator element
c) a piezoelectric body bonded to the main body, and
d) means for electrically connecting the piezoelectric body and the resonator element to and alternating current source for energising the resonator element and causing its resonatiow further comprising
e) a mounting structure,
f) means for mounting a transducer assembly,
g) means for admitting an operating fluid into contact with the face of the main body of the resonator element remote from the piezoelectric body and means for displacing the fluid to a remote location after interaction of the resonator when energised, and
h) means for energising the piezoelectric body.

15. An acoustic transducer assembly comprising a generally planar diaphragm having piezoelectric transducer material in a central portion and a mounting flange extending from a peripheral portion transversely to the generally planar diaphragm, and first and second mounting elements engaging and mounting the flange on its inner and outer sides respectively whereby an assembly is adapted to be mounted for acoustic output when the piezoelectric transducer is electrically driven, further comprising an acoustic structure defining an acoustic path for sound generated by the diaphragm and extending away from the main body of the diaphragm on its side remote from the piezoelectric body.

16. An assembly as defined in claim 5 and wherein the diaphragm is disc-shaped with the flange being a depending skirt extending approximately at right angles to the general plane of the diaphragm.

17. An assembly as defined in claim 16 and wherein the first and second mounting elements are respective rings and the skirt is of corresponding shape to be clamped between the rings in an interference fit.

18. A transducer assembly as claimed in claim 6, wherein the assembly is of circular form and of dimensions of about 2 cm diameter and 2 mm axial depth.

19. An acoustic emitter as claimed in claim 8 and wherein the acoustic structure includes a rigid body spaced from and adjacent to the resonator main body and having a central aperture which is small in area compared to the main body of the resonator and further comprising a horn device acoustically matched to the transducer assembly to control the acoustic output along the axis of the main body and the horn is substantially a tapering conical shaped body having its lesser diameter remote from the main body and of a length similar to the dimensions across the resonator main body.

20. An acoustic emitter as claimed in claim 19 and wherein the device is arranged to provide an acoustic signal at about 3 kHz, wherein the mass-spring resonance in the disc-shaped resonator is inherently at about 3 kHz, the electrical drive circuit has a capacitor-inductance resonance in the circuit of about 3 kHz, the piezoelectric body has an inherent resonance at about 3 kHz and the acoustic structure has inherent resonance at about 3 kHz and has an acoustic guide wall dimensioned to transform a high pressure, small displacement in the operating fluid in the structure into a low pressure, high displacement and high volume acoustic signal.

* * * * *